United States Patent [19]

Stemler et al.

[11] 4,291,193

[45] Sep. 22, 1981

[54] SELF-MONITORING HIGH VOLTAGE TRANSMISSION LINE SUSPENSION INSULATOR

[75] Inventors: Gary E. Stemler; Donald N. Scott, both of Vancouver, Wash.

[73] Assignee: The United States of America as represented by the United States Department of Energy, Washington, D.C.

[21] Appl. No.: 148,322

[22] Filed: May 9, 1980

[51] Int. Cl.[3] ..... H01B 17/02; H01B 17/34; H01B 17/36

[52] U.S. Cl. ..... 174/11 R; 73/40; 116/264; 174/30; 174/179

[58] Field of Search ..... 174/11 R, 11 BH, 30, 174/179; 116/264; 73/40.7, 49.3, 40; 340/647

[56] References Cited

U.S. PATENT DOCUMENTS

| | | | |
|---|---|---|---|
| 1,770,130 | 7/1930 | Dunmire | 174/179 X |
| 1,786,767 | 12/1930 | Miller | 174/30 X |
| 1,915,965 | 6/1933 | Williams | 116/264 X |
| 2,970,186 | 1/1961 | Von Platen | 174/30 X |
| 3,003,349 | 10/1961 | Sullivan et al. | 73/40.7 |
| 4,185,161 | 1/1980 | Huang et al. | 174/179 X |

FOREIGN PATENT DOCUMENTS

| | | | |
|---|---|---|---|
| 517056 | 12/1920 | France | 174/30 |
| 1357749 | 3/1964 | France | 174/179 |
| 249506 | 10/1926 | United Kingdom | 174/11 BH |

*Primary Examiner*—Laramie E. Askin
*Attorney, Agent, or Firm*—Douglas E. Erickson; Richard E. Constant; Richard G. Besha

[57] ABSTRACT

A high voltage transmission line suspension insulator (18 or 22) which monitors its own dielectric integrity. A dielectric rod (10) has one larger diameter end fitting attachable to a transmission line and another larger diameter end fitting attachable to a support tower. The rod is enclosed in a dielectric tube (14) which is hermetically sealed to the rod's end fittings such that a liquid-tight space (20) is formed between the rod and the tube. A pressurized dielectric liquid is placed within that space. A discoloring dye placed within this space is used to detect the loss of the pressurized liquid.

2 Claims, 6 Drawing Figures

SELF-MONITORING HIGH VOLTAGE TRANSMISSION LINE SUSPENSION INSULATOR

The United States Government has rights in this invention.

BACKGROUND OF THE INVENTION

The present invention relates generally to electrical insulators and more particularly to a self-monitoring high voltage transmission line suspension insulator for connecting a high voltage transmission line to a transmission line support structure.

Electric power transmission line suspension insulators are subject to damage from causes such as weather conditions and gunfire or other vandalism. A typical insulator in the prior art would contain a central dielectric rod to support the weight of the transmission line. This central dielectric rod must be made of a material having sufficient tensile strength, but such materials, like fiberglass, will lose their dielectric properties when exposed to the environment. For example, water on the surface of such a rod will lead to arcing in the electrical environment of the power line. In time, due to arcing damage, the rod might fail and drop the line. To protect the dielectric rod from the environment, the prior art has employed a dielectric tube to surround the rod. This tube may be made from a plastic or rubber material to have good dielectric properties while exposed to the environment. It should be noted that these materials have inadequate tensile strength to support the transmission line. Some prior art insulators bonded the tube directly to the rod. Other prior art insulators left an annular space between the tube and the rod and filled that space with a dielectric material such as an insulating liquid. Both types of such prior art insulators would be damaged when moisture would enter the tube (and contact the rod) due to gunshot holes or adverse weather conditions. Of course the insulators would be damaged from the gunshots themselves.

The prior art has responded to this problem by helicopter and ground visual inspections of the transmission line insulators. Observers in the helicopters or on the ground try to detect gunfire or other damage. Even with binoculars or other optical aids, this is often very difficult because of the small size of the gunshot hole in the tube and the relatively large distance at which the insulator would be viewed. Moisture penetration damage due to normal wear and tear of the insulator in the environment cannot be detected in this manner until such damage is severe. The goal of the periodic visual inspections is to detect a damaged insulator before it fails and drops a power line.

SUMMARY OF THE INVENTION

It is an object of the invention to detect the loss of the dielectric integrity of an electric power transmission line suspension insulator.

It is another object of the invention to detect when the outer tube of an electric power transmission line suspension insulator no longer provides environmental protection for the interior dielectric rod.

It is a further object of the invention to detect when the outer tube of an electric power transmission line suspension insulator has been hit by gunfire.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the insulator of this invention may comprise an insulative rod having one end fitting to attach one end of the rod to the transmission line and a second end fitting on the other end of the rod to attach that end to a transmission line support such as a tower. The end fittings have larger diameters than the diameter of the rod. An insulative tube surrounds the rod and has a larger diameter than the rod so it does not touch it. The tube is hermetically attached to each of the end fittings. This creates a liquidtight space within the tube. An insulative liquid is put, under pressure, within the space. Loss of this pressurized liquid is detected by sighting a dye previously added in the space.

Several benefits and advantages are derived from the invention. Gunfire damage to an insulator is more easily detected. Internal damage to an insulator due to environmental penetration of the outer tube by moisture is also more easily detected. Damage to insulators may be detected earlier and more reliably than with existing insulators.

BRIEF DESCRIPTION OF THE DRAWINGS

The accompanying drawings, which are incorporated in and form a part of this specification, illustrate two embodiments of the present invention and, together with the description, serve to explain the principles of the invention. In the drawings.

DETAILED DESCRIPTION OF THE INVENTION

Figure 1:
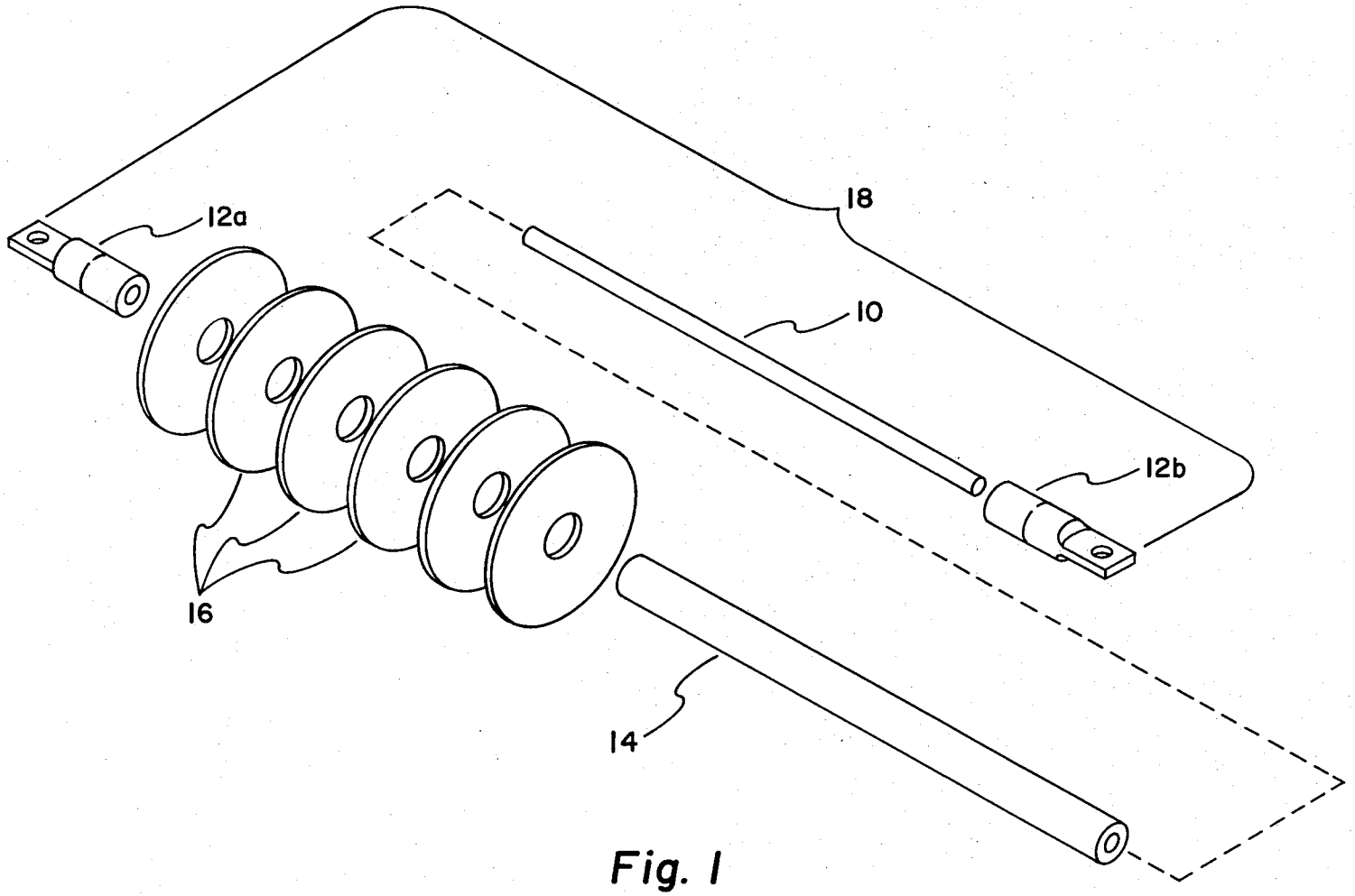
FIG. 1 is an exploded view of the mechanical parts of the insulator.

FIG. 1 shows the unassembled mechanical parts of the insulator. A rod 10 has sufficient tensile strength to support the weight of a high voltage transmission line in suspension from a transmission line support structure. The rod is usually cylindrical in shape, and of considerable length for proper insulative protection of the line. Materials having the required tensile strength of the rod 10 must also possess sufficient dielectric or insulative properties. Such materials, like fiber glass, lose their dielectric properties when exposed to the environment. Moisture and other particles collecting on the surface of the rod will cause local arcing and pitting, leading to decomposition of the rod. Each end of the rod 10 is associated with a separate end fitting. The end fitting is generally made of metal. Each of the end fittings 12*a* and 12*b* has a diameter greater than the diameter of the rod 10. One of the end fittings 12*a* is used for attachment to a high voltage transmission line. The other end fitting 12*b* is used for attachment to a transmission line support structure. A high voltage transmission line is defined as one carrying alternating or direct current greater than or equal to 115 kilovolts. A typical transmission line support structure would be a tower.

An insulative or dielectric tube 14 is generally cylindrical in shape and is disposed coaxially around the rod 10. The tube has good dielectric or insulative properties which hold up even in an adverse environment. A preferred material would be ethylene-propylene rubbers. A test material for temporary use would be polyvinyl chloride. Such materials however do not have sufficient tensile strength to support the weight of a high voltage transmission line. The inside surface of the tube 14 is attachable to the exterior surface of the end fittings 12*a* and 12*b*. Sheds 16 are insulative discs used on insulators for lengthening the surface distance between electrodes. They may also be used for electrical grading purposes. They are conventional items and can be made of the same materials as those making up the tube 14. The sheds 16 could be made independently of the tube 14, or the sheds and tubes could be made as one unit.

Figure 2:
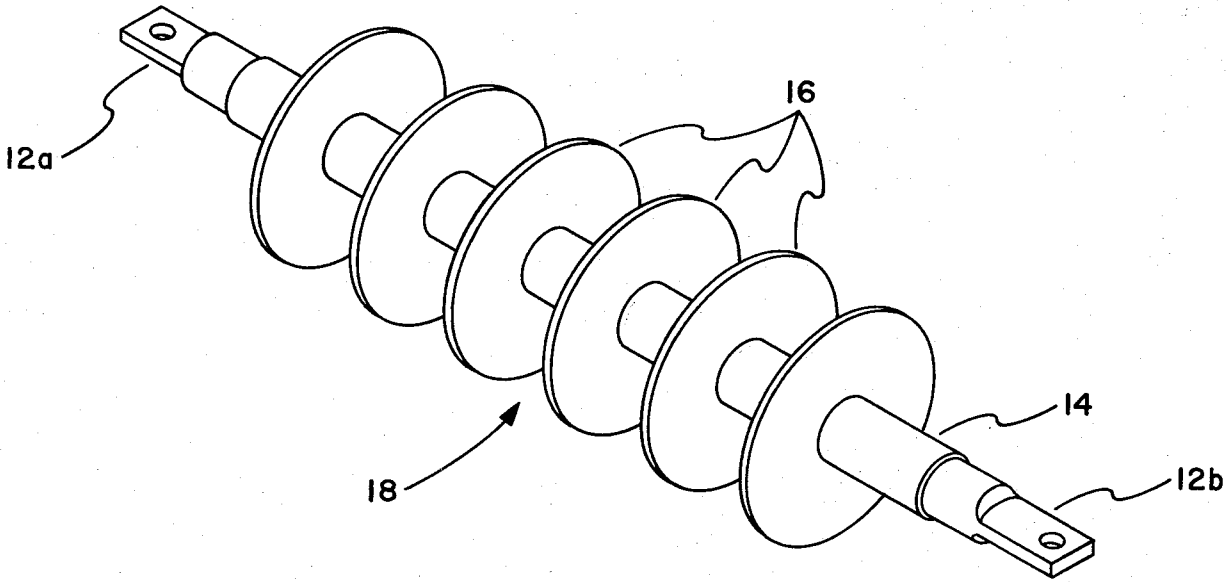
FIG. 2 is a perspective view of the fully assembled insulator of FIG. 1, which also contains an insulative pressurized liquid and a discoloring dye.

In FIG. 2, the end fittings 12*a* and 12*b* are attached to the ends of the rod 10. The end fittings are coaxially affixed to the rod. Each end fitting may have a cylindrical cavity to receive the ends of the rod 10 with the attachment accomplished by mechanical holding and or chemical bonding (such as with epoxy cement). To aid in any gluing, a small weep hole may be drilled in each of the end fittings 12*a* and 12*b* to allow any excess epoxy to escape when the ends of the rod 10 are inserted into the end fittings. The sheds 16 are shown attached to the outer surface of tube 14. The sheds 16 are spaced apart and usually equidistant for electrical grading purposes. The sheds 16 may be likewise glued or otherwise affixed to the tube 14. The rod 10 with attached end fittings 12*a* and 12*b* is inserted into the tube 14, and the tube 14 is hermetically sealed to the end fittings. The fluidtight seal could be formed by a combination of "O" rings, clamps, sealants, and cement.

To make the insulator self-monitoring, one embodiment of the invention would introduce a compressed insulative fluid into the fluidtight space formed around the rod between the end fittings within the tube. A liquid having the required insulative properties would be an electrical grade mineral oil. A discoloring nonionic organic dye would also be placed within this fluidtight space. An example of such a dye would be alpha-naphtholbenzene. The liquid and dye would be inserted in the fluidtight space under pressure after the tube 14 is hermetically sealed to the end fittings 12*a* and 12*b*. A method of insertion would be through a small hole drilled in one of the end fittings. After attachment of the tube 14 to the end fittings, the liquid and dye would be introduced into the space through this hole and then the hole would be sealed. A standard plug could be used for this sealing. The liquid/dye insulator 18 is shown in FIG. 2.

Figure 3:
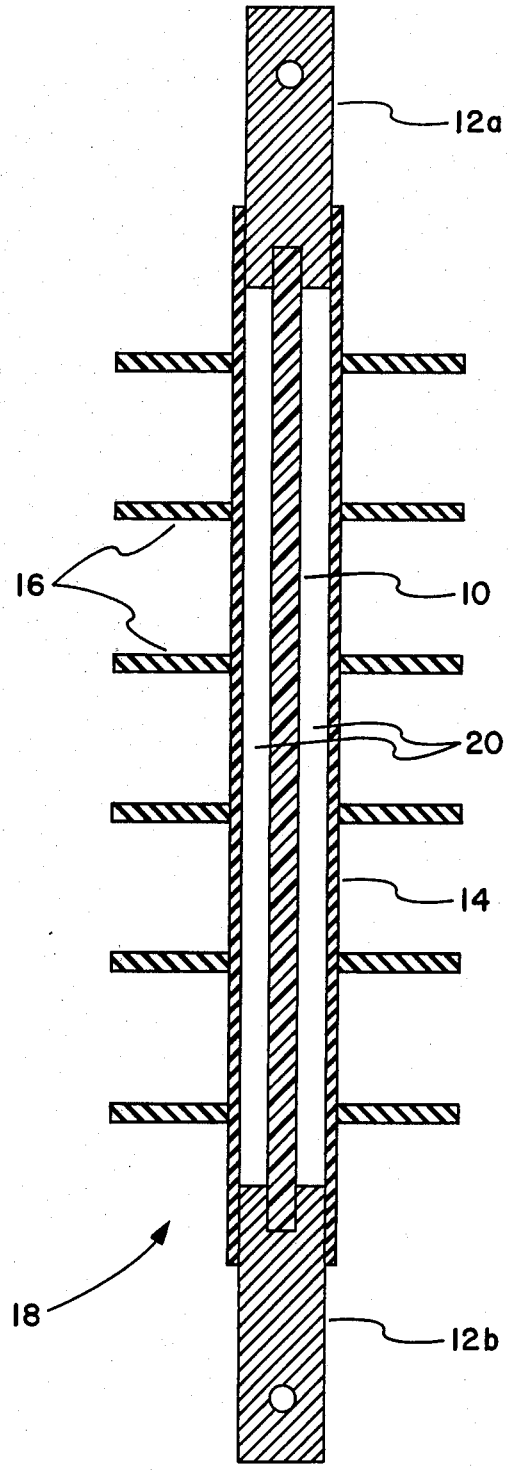
FIG. 3 is a sectional view of the liquid/dye self-monitoring insulator of FIG. 2.
Figure 4:
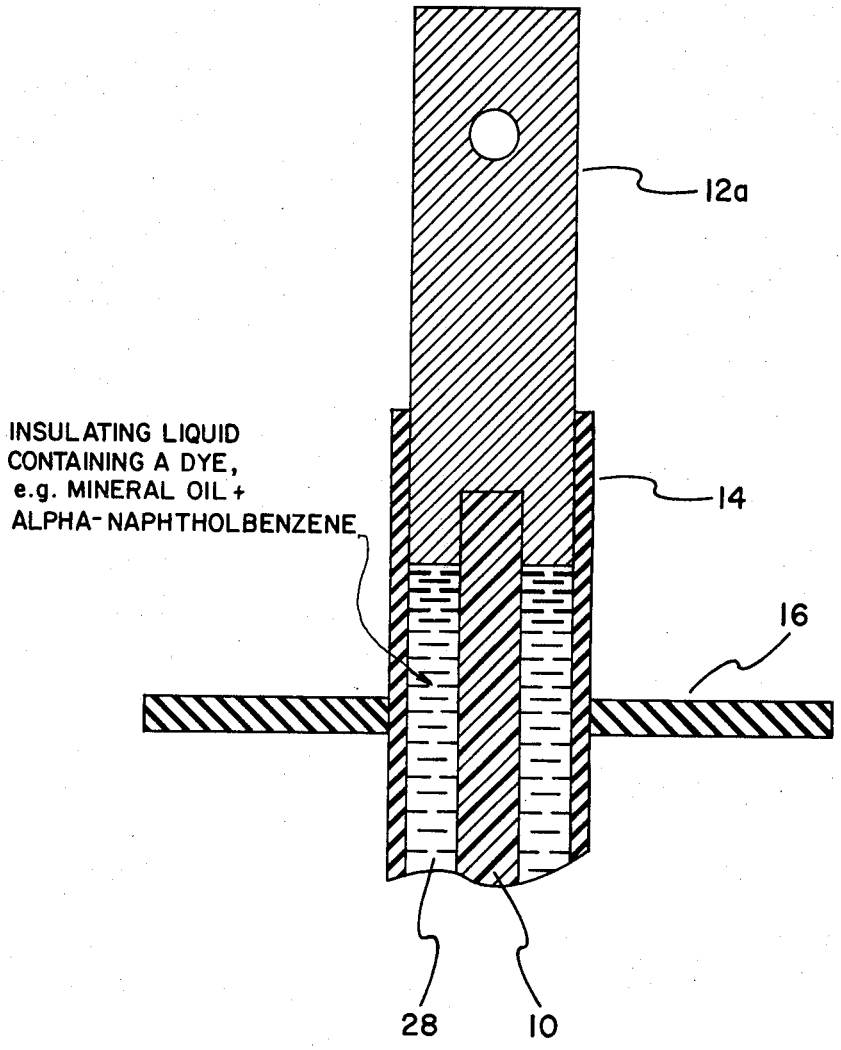
FIG. 4 is a sectional fragmentary view of the top portion of the insulator of FIG. 3 showing the liquid and dye composition.

FIG. 3 is a sectional view of FIG. 2. The airtight space 20 is annular in shape. FIG. 4 shows the top part of FIG. 3 with the fluidtight space filled with the pressurized liquid and discoloring dye composition 28.

Figure 5:
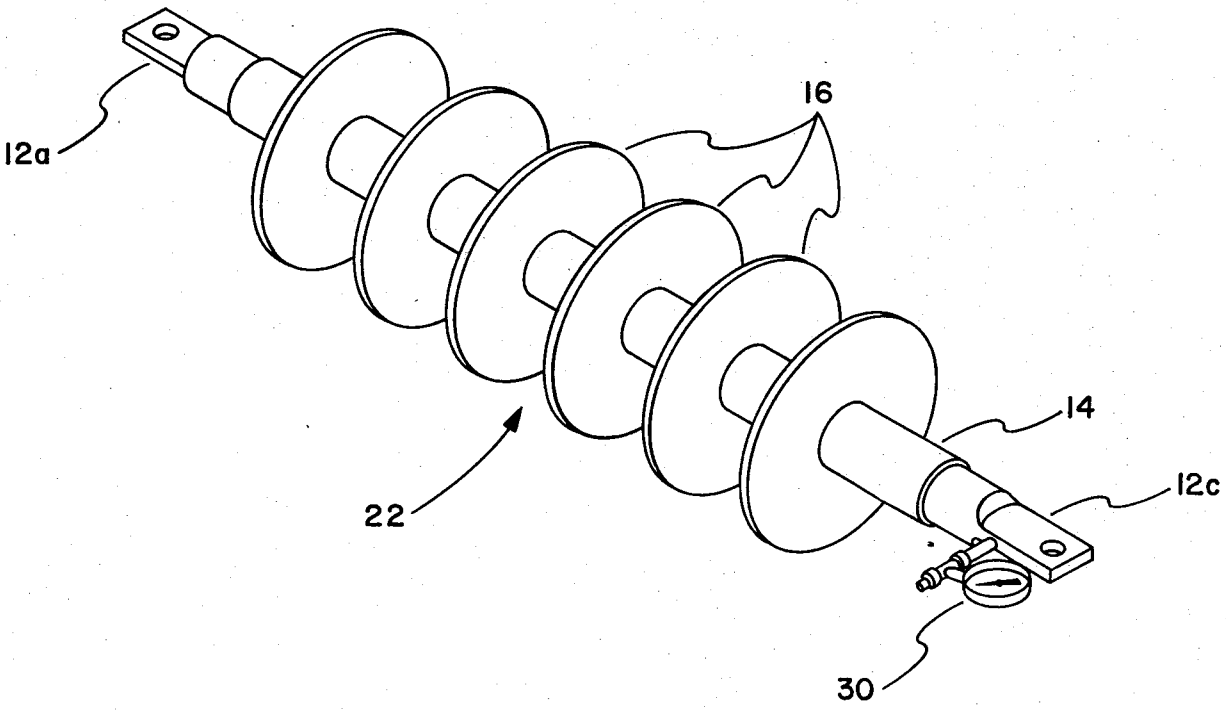
FIG. 5 is an alternative embodiment of the insulator of FIG. 2, having an insulative compressed gas and a pressure gauge in place of the insulative compressed liquid and discoloring dye.

FIG. 5 represents an alternative embodiment of the invention. The insulator 22 in FIG. 5 is an example of the gas/pressure monitor type. In FIG. 5 a pressure gauge 30 is shown attached to one of the end fittings 12*c*. A channel in that end fitting connects the pressure gauge to the fluidtight space within the tube 14.

Figure 6:
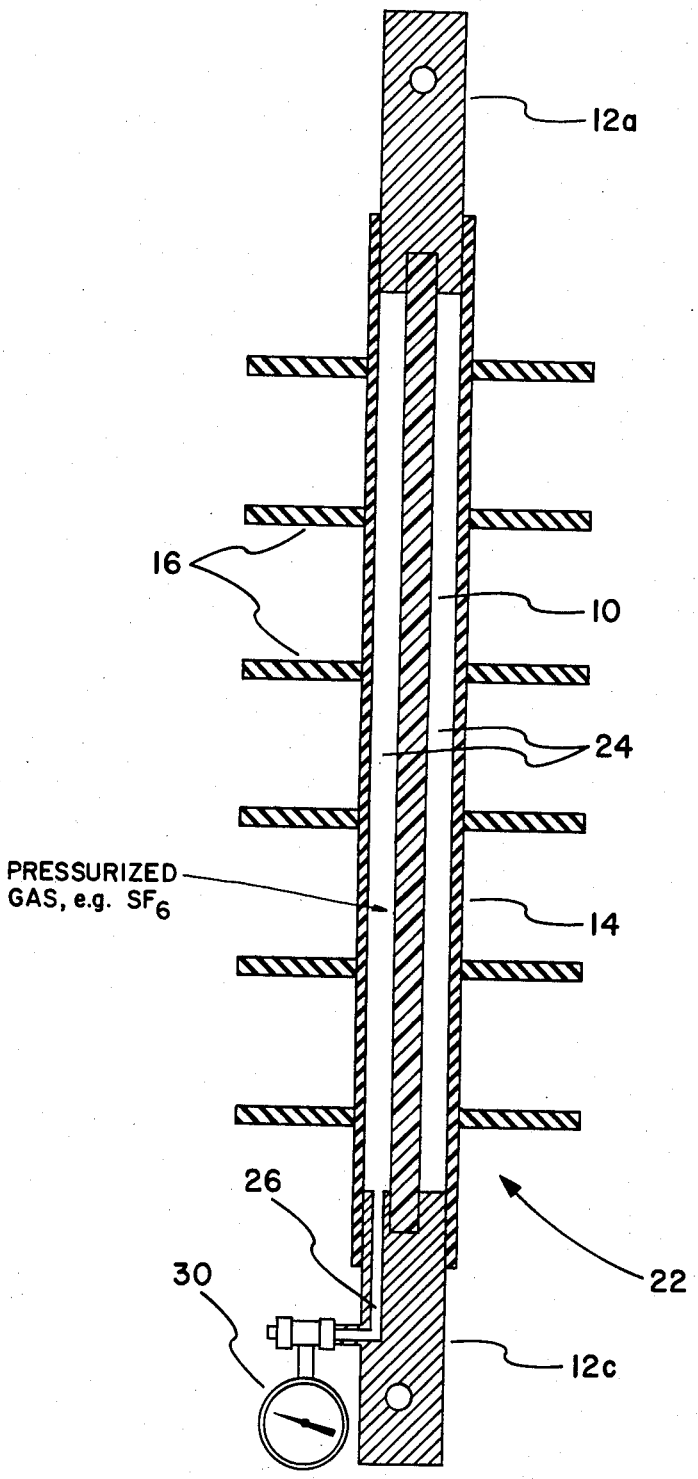
FIG. 6 is a schematic view of the gas/pressure gauge selfmonitoring insulator of FIG. 5.

This is shown in FIG. 6, which is a sectional view of the insulator of FIG. 5. In FIG. 6, the top end fitting 12*c* contains a channel 26 connecting the fluidtight space 24 within the tube with the pressure gauge 30 outside the end fitting 12*c*. The airtight space 24 of the insulator 22 would contain a compressed gas such as sulfur hexafluoride.

Reference will now be made to an example of the invention in which the self-monitoring high voltage transmission line suspension insulator includes a pressurized sulfur hexafluoride gas placed within an airtight space formed between a central, strong, dielectric rod and a surrounding, structurally weaker, but environmentally resistant, dielectric tube. A pressure monitor is provided for detecting loss of the pressurized gas from the airtight space within the insulator. Such a monitor would have an indicator, located outside the tube, which is clearly visible at a distance, and a sensor located within the airtight space. A simple pressure gauge having a large enough dial would be sufficient. Loss of pressure could easily be seen through binoculars (from the ground or from a helicopter) when the indicator is near the transmission line insulator.

The operation of this example of the invention would begin with the insulator, having dielectric integrity, installed in a power system. The pressurized gas within the airtight space would not have leaked, and so no loss of pressure would be indicated by the pressure gauge. Thus, during a periodic inspection of the transmission line insulators by the power company, an inspector would see no indication of loss of pressure and hence no indication of loss of dielectric integrity of the insulator. Later, the insulator may be damaged due to gunfire from vandals, or lose its hermetic seal due to environmental factors and general deterioration of the insulator over time. An inspector now making a periodic inspection of the insulators would see a loss of pressure. The inspector would then call for replacement of the insulator before continued damage would lead to complete loss of the insulator and the dropping of the transmission line.

The high voltage transmission line suspension insulator of the invention monitors the loss of the insulator's dielectric integrity by employing a pressurized dielectric fluid within a fluidtight space created between the insulator's dielectric rod and surrounding environmentally resistant dielectric tube. Means are also employed for detecting the loss of the pressurized fluid within the insulator which would indicate loss of dielectric integrity. The advantage of the invention is that overt damage to transmission line insulators may be detected more easily than with existing techniques, and covert damage to insulators may be detected which the prior art cannot detect.

The foregoing description of a preferred embodiment of the invention has been presented for purposes of illustration and description. It is not intended to be exhaustive or to limit the invention in the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A high voltage transmission line suspension insulator for connecting a high voltage transmission line to a transmission line support structure comprising:

a. an elongated generally cylindrical dielectric rod with two ends;

b. two generally cylindrical end fittings, one of said end fittings coaxially affixed to one end of said rod and the other of said end fittings coaxially affixed to the other end of said rod, for connecting one end to said high voltage transmission line and the other end to said transmission line support structure, each of said end fittings having a diameter greater than the diameter of said rod;

c. a generally cylindrical dielectric tube with sheds, said tube enclosing and spaced from said rod and hermetically sealed to said end fittings forming a liquidtight space within said tube between said end fittings around said rod;

d. a pressurized dielectric liquid disposed within said space; and e. a non-ionic organic discoloring dye disposed in said space for detecting loss of pressurized liquid from said space.

2. The insulator of claim 1 wherein said liquid comprises an electrical grade mineral oil and said dye comprises alpha-naphtholbenzene.

* * * * *